US010377523B2

(12) United States Patent
Hayslette et al.

(10) Patent No.: US 10,377,523 B2
(45) Date of Patent: Aug. 13, 2019

(54) CARTON AND BLANK THEREFOR

(71) Applicant: WestRock Packaging Systems, LLC, Norcross, GA (US)

(72) Inventors: David T. Hayslette, Midlothian, VA (US); Bradford J. Walling, Chesterfield, VA (US); Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 195 days.

(21) Appl. No.: 15/497,990

(22) Filed: Apr. 26, 2017

(65) Prior Publication Data

US 2017/0313469 A1 Nov. 2, 2017

Related U.S. Application Data

(60) Provisional application No. 62/328,852, filed on Apr. 28, 2016.

(51) Int. Cl.

| | |
|---|---|
| ***B65D 5/50*** | (2006.01) |
| ***B65D 5/18*** | (2006.01) |
| ***B65D 5/42*** | (2006.01) |
| ***B65D 5/468*** | (2006.01) |

(52) U.S. Cl.

CPC ..... *B65D 5/5004* (2013.01); *B65D 5/18* (2013.01); *B65D 5/4266* (2013.01); *B65D 5/4608* (2013.01)

(58) Field of Classification Search

CPC ..... B65D 5/5004; B65D 5/18; B65D 5/4266; B65D 5/4608; B65D 5/0245; B65D 5/443; B65D 71/36; B65D 2571/00141; B65D 2571/0066; B65D 2571/00728

See application file for complete search history.

(56) References Cited

U.S. PATENT DOCUMENTS

| | | | | |
|---|---|---|---|---|
| 2,398,404 A * | 4/1946 | Brooks | B65D 5/12 229/125.08 |
| 2,555,581 A | 6/1951 | Dunning | |
| 2,603,401 A | 7/1952 | Strauss | |
| 2,603,402 A * | 7/1952 | Strauss | B65D 5/06 229/110 |
| 3,660,116 A * | 5/1972 | Clark | B65D 5/4295 206/521.1 |
| 3,788,538 A | 1/1974 | Kuenzi | |
| 4,266,715 A * | 5/1981 | Garrison | B65D 5/5011 206/425 |

(Continued)

FOREIGN PATENT DOCUMENTS

WO WO 2010/096536 A2 8/2010

*Primary Examiner* — Corey N Skurdal
(74) *Attorney, Agent, or Firm* — WestRock Intellectual Property Group

(57) ABSTRACT

Aspects of the disclosure relate to a carton for packaging one or more articles. The carton includes a tubular structure having a plurality of outer walls defining an interior volume for receiving one or more articles. The carton includes an inner end closure flap hinged to a first one of the plurality of outer walls and an outer end closure flap hinged to a second one of the plurality of outer walls. The outer end closure flap at least partially overlies the inner end closure flap. The carton includes an automatically erecting article retaining structure hingedly connected to the outer end closure flap.

11 Claims, 9 Drawing Sheets

(56) References Cited

U.S. PATENT DOCUMENTS

| | | | | |
|---|---|---|---|---|
| 6,227,442 | B1 * | 5/2001 | Evans, Jr. ..... | B65D 5/443<br>229/122.27 |
| 8,439,194 | B2 * | 5/2013 | Spivey ..... | B65D 71/36<br>206/427 |
| 8,919,557 | B2 | 12/2014 | Spivey, Sr. | |
| 2008/0128479 | A1 | 6/2008 | Bates et al. | |
| 2014/0021084 | A1 | 1/2014 | Holley, Jr. | |

* cited by examiner

CARTON AND BLANK THEREFOR

TECHNICAL FIELD

The present invention relates to cartons and to blanks for forming the same. More specifically, but not exclusively, the invention relates to a carton having a cushioning structure for constraining articles within an interior volume of the carton.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton, and that the carton is a close or tight fit about the contents, so as to prevent or inhibit movement of the contents within the carton.

The present invention seeks to provide an improvement in the field of cartons, typically formed from paperboard or the like.

SUMMARY

According to a first aspect of the present disclosure there is provided a carton for packaging one or more articles. The carton comprises a tubular structure having a plurality of outer walls defining an interior volume for receiving the one or more articles. The carton may comprise an inner end closure flap hinged to a first one of the plurality of outer walls. An outer end closure flap is hinged to a second one of the plurality of outer walls. The outer end closure flap at least partially overlies the inner end closure flap. The carton comprises an automatically erecting article retaining structure hingedly connected to the outer end closure flap.

Optionally, the inner end closure flap is dimensioned so as to provide a gap between a side edge thereof and the second one of the plurality of outer walls, the gap receiving at least a portion of the automatically erecting article retaining structure.

Optionally, the automatically erecting article retaining structure comprises a first panel hinged to the outer end closure flap and disposed in face to face relationship with the outer end closure flap.

Optionally, the automatically erecting article retaining structure comprises a second panel secured to an inner surface of the second one of the plurality of outer walls.

Optionally, the automatically erecting article retaining structure comprises a pair of intermediate panels hingedly connecting the second panel to the first panel.

Optionally, a first intermediate panel is hingedly connected to the first panel and forms a riser panel.

In some embodiments, a first intermediate panel extends through the gap between the side edge of the inner end closure flap and the second one of the plurality of outer walls.

Optionally, a second intermediate panel is hingedly connected along a first edge to the first intermediate panel and is hingedly connected to the second panel along a second edge, the second edge opposing the first edge.

In some embodiments, the automatically erecting article retaining structure comprises a second panel hingedly connected to the first panel of the automatically erecting article retaining structure.

Optionally, the second panel extends through the gap between the side edge of the inner end closure flap and the second one of the plurality of outer walls.

Optionally, the second panel is at least partially spaced apart from the second one of the plurality of outer walls.

Optionally, the second panel is at least partially spaced apart from the first panel of the automatically erecting article retaining structure.

Optionally, the second panel is divergently arranged with respect to the first panel of the automatically erecting article retaining structure.

Optionally, the second panel is divergently arranged with respect to the second one of the plurality of outer walls.

According to a second aspect of the present disclosure there is provided a blank for forming a carton. The blank comprises a plurality of panels for forming outer walls of a tubular structure defining an interior volume for receiving one or more articles in a set up condition. The blank comprises an inner end closure flap hinged to a first one of the plurality of outer walls and an outer end closure flap hinged to a second one of the plurality of outer walls. The outer end closure flap is arranged to at least partially overlie the inner end closure flap in a set up condition. The blank comprises two or more panels hingedly connected in a linear series for forming an automatically erecting article retaining structure; one of said two or more panels is hingedly connected to the outer end closure flap.

According to a third aspect of the present disclosure there is provided a package comprising a carton and at least one article having a first tubular axis disposed within the carton. The carton comprises a tubular structure having a plurality of outer walls defining an interior volume for receiving one or more articles, the tubular structure defining a second tubular axis and an end closure flap including an automatically erectable article neck-retaining structure. The first tubular axis and the second tubular axis are arranged to be parallel to each other.

According to a fourth aspect of the present disclosure there is provided a blank for forming a tubular carton. The carton comprises a first tube wall-forming panel and a second tube wall-forming panel, the second tube wall-forming panel is hinged to the first tube wall-forming panel. The carton comprises a first series of end closure panels, wherein the first series of end closure panels is hinged to the first tube wall-forming panel along a first side of the blank. The carton comprises a second series of end closure panels, wherein the second series of end closure panels is hinged to the second tube wall-forming panel along the first side of the blank. Each of the first and second series of end closure panels comprises three or more panels hingedly connected in series.

Optionally, each of the first and second series of end closure panels comprises five or more panels hingedly connected in series.

Optionally, one of the first and second series of end closure panels comprises three panels hingedly connected in series and the other one of the first and second series of end closure panels comprises five panels hingedly connected in series.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
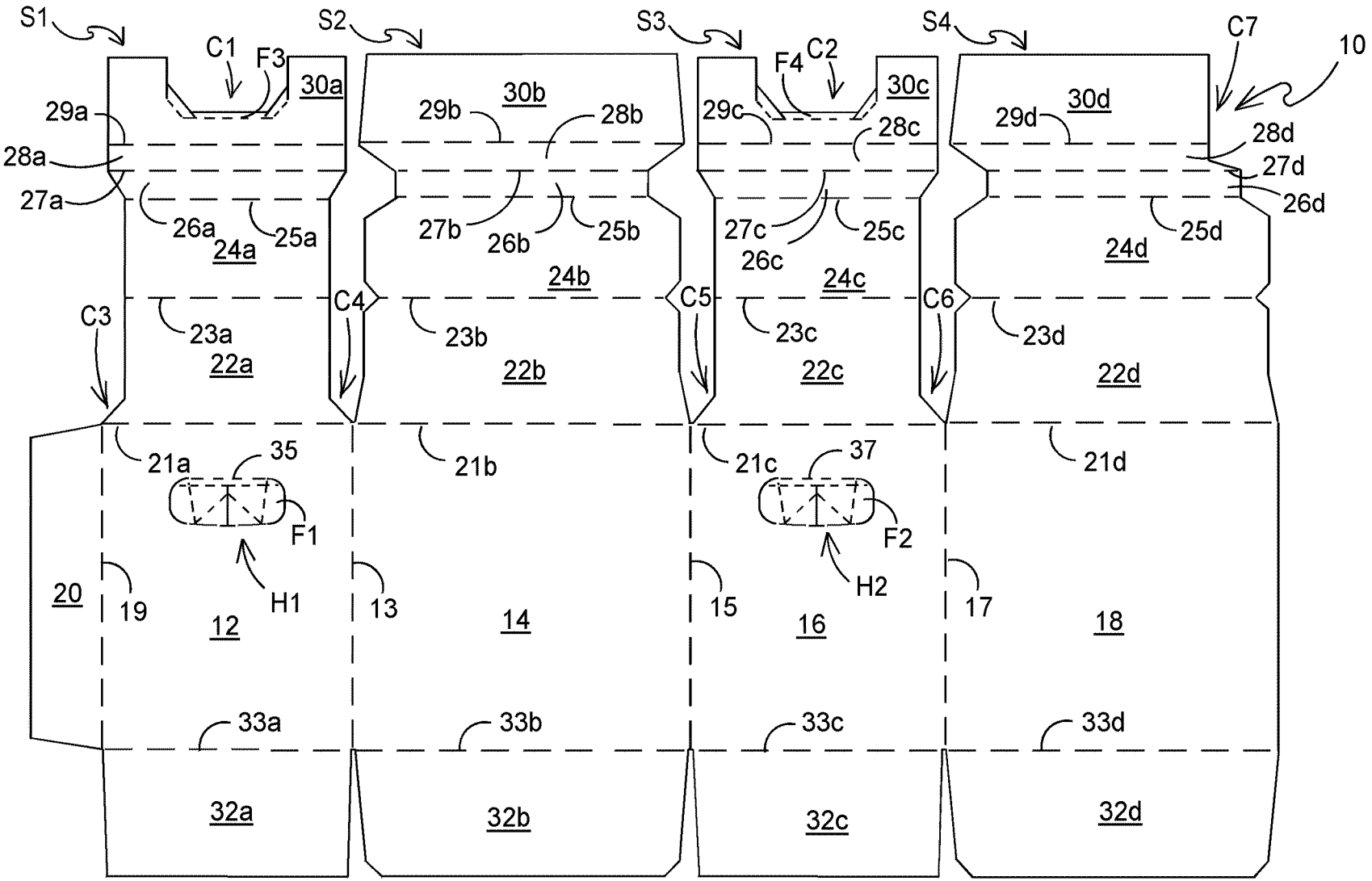
FIG. 1 is a plan view from above of a blank for forming a carton according to a first embodiment.
Figure 2:
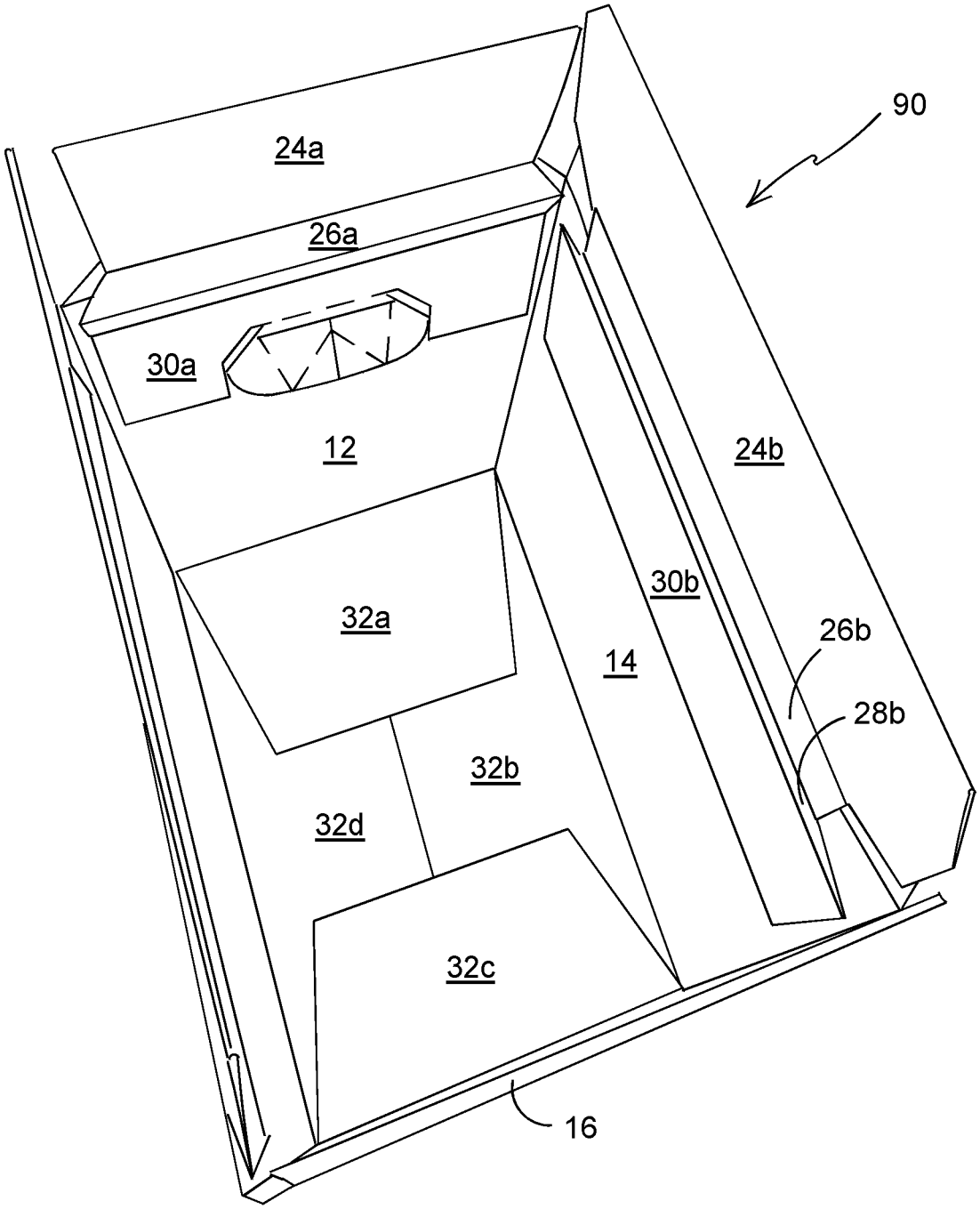
FIG. 2 is a perspective view of a stage of assembly of a carton from the blank of FIG. 1.

Referring to FIG. 1, there is shown a plan view of a blank 10 capable of forming a carton or carrier 90, as shown in FIG. 2, for containing and carrying a group of primary products such as, but not limited to, bottles or cans, hereinafter referred to as articles B. The blank 10 forms a secondary package for packaging at least one primary product container or package.

Figure 6:
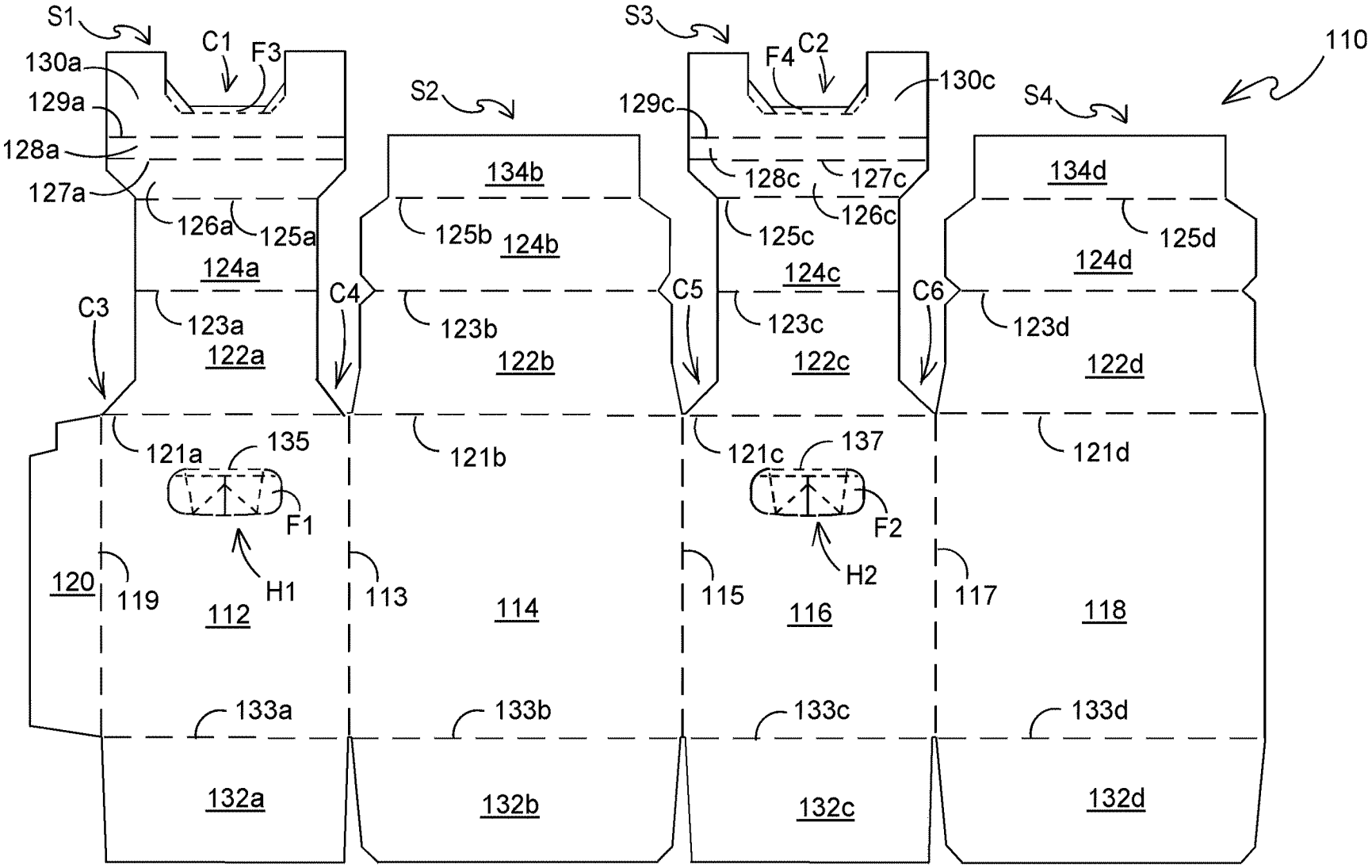
FIG. 6 is a plan view from above of a blank for forming a carton according to a second embodiment.
Figure 9:
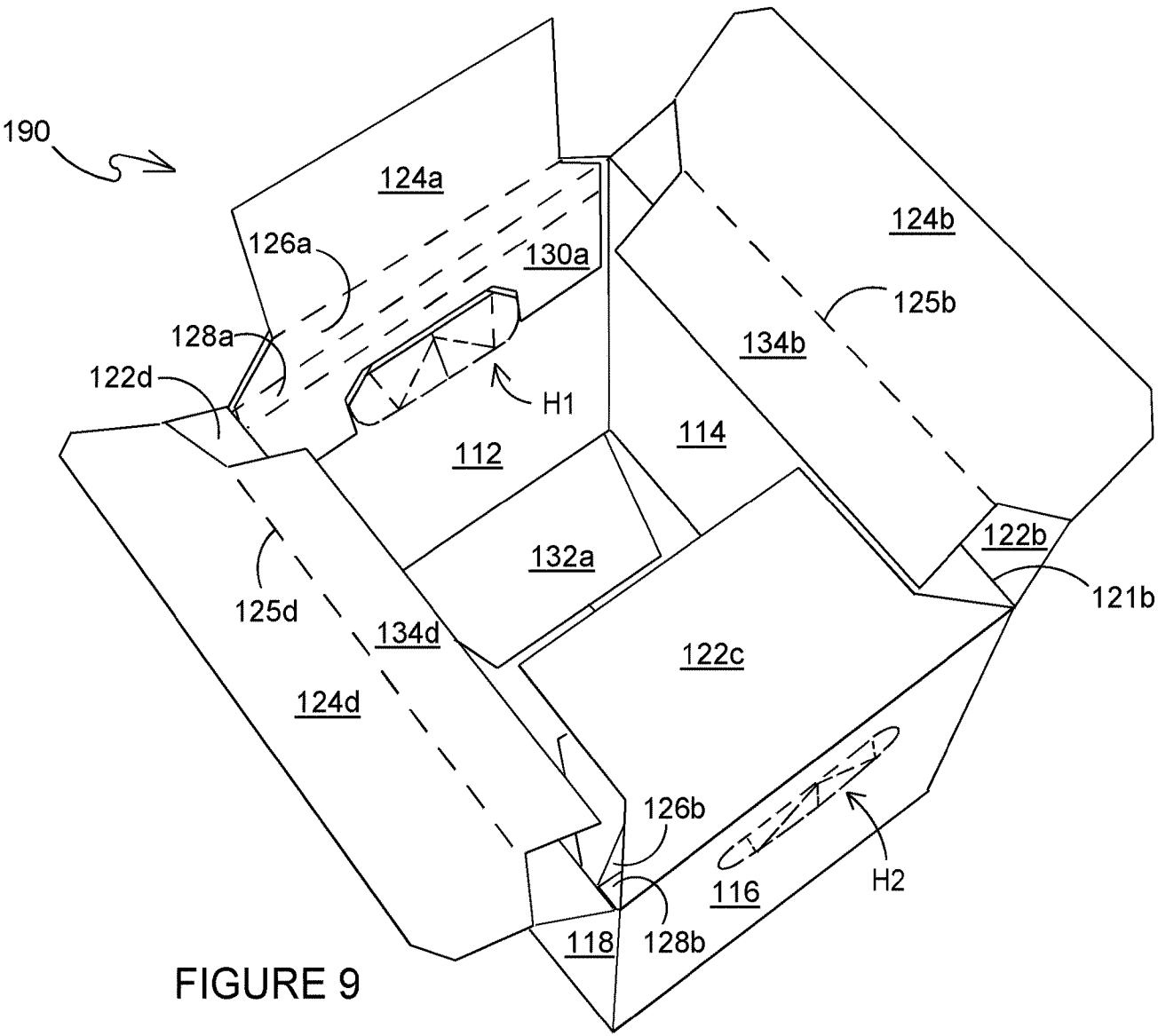
FIG. 9 is a perspective view of a stage of assembly of a carton from the blank of FIG. 6.

Referring to FIG. 6, there is shown a plan view of a blank 110 capable of forming a carton or carrier 190, as shown in FIG. 9, for containing and carrying a group of primary products such as, but not limited to, bottles or cans, hereinafter referred to as articles (not shown). The blank 110 forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10,110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

In the illustrated embodiment, the blanks 10,110 are configured to form a carton or carrier 90, 190 for packaging an exemplary arrangement of exemplary articles B. In the illustrated embodiment, the arrangement is a 3×4 matrix or array; in the illustrated embodiment three rows of four articles are provided and the articles B are bottles. Alternatively, the blanks 10, 110 can be configured to form a carrier for packaging other types, number and size of articles and/or for packaging articles in a different arrangement or configuration.

Figure 4:
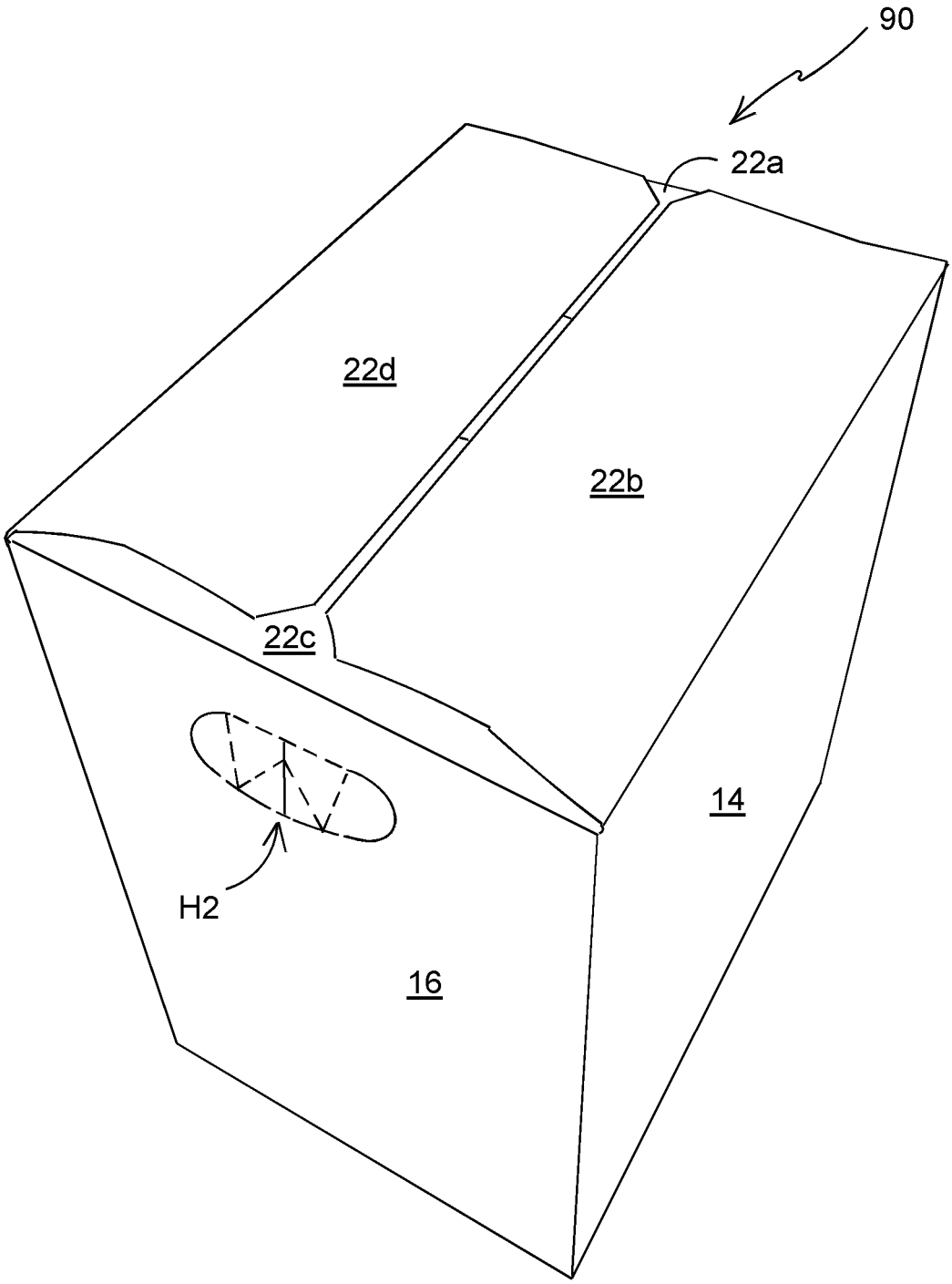
FIG. 4 is a perspective view from above of a carton formed from the blank of FIG. 1.

Referring to FIG. 1, the blank 10 comprises a plurality of main panels 12, 14, 16, 18 for forming outer walls of a carton carrier 90 (see FIG. 4). The plurality of main panels 12, 14, 16, 18 includes a first end panel 12. The first end panel 12 is hinged to a first side panel 14 by a hinged connection such as a fold line 13. The first side panel 14 is hinged to a second end panel 16 by a hinged connection such as a fold line 15. The second end panel 16 is hinged to a second side panel 18 by a hinged connection such as a fold line 17. The first end panel 12 is hinged to a securing panel 20 by a hinged connection such as a fold line 19. The plurality of main panels 12, 14, 16, 18 define a tubular structure in a set up carton 90.

The blank 10 comprises at least one panel for forming a base wall of the carton 90. Optionally, the blank 10 comprises a first base panel 32*a* hinged to the first end panel 12 by a hinged connection such as a fold line 33*a*, a second base panel 32*b* hinged to the first side panel 14 by a hinged connection such as a fold line 33*b*, a third base panel 32*c* hinged to the second end panel 16 by a hinged connection such as a fold line 33*c* and a fourth base panel 32*d* hinged to the second side panel 18 by a hinged connection such as a fold line 33*d*.

The blank 10 comprises a plurality of panels 22*a*, 22*b*, 22*c*, 22*d* for forming a composite top wall of the carton 90. The blank 10 comprises a first top panel 22*a* hinged to the first end panel 12 by a hinged connection such as a fold line 21*a*, a second top panel 22*b* hinged to the first side panel 14 by a hinged connection such as a fold line 21*b*, a third top panel 22*c* hinged to the second end panel 16 by a hinged connection such as a fold line 21*c* and a fourth top panel 22*d* hinged to the second side panel 18 by a hinged connection such as a fold line 21*d*.

The second and fourth top panels 22*b*, 22*d* form outer top panels and together substantially close a first, upper, end of the tubular structure defined by the plurality of main panels 12, 14, 16, 18.

The first and third top panels 22*a*, 22*c* form inner top panels or dust flaps and together at least partially close the first, upper, end of the tubular structure defined by the plurality of main panels 12, 14, 16, 18.

Optionally, the first and second end panels 12, 16 each comprises a handle structure H1, H2 respectively. Each handle structure H1, H2 comprises a handle opening defined in the respective one of the first and second end panels 12, 16. Each handle opening is defined at least in part by a cushioning flap F1, F2 respectively. A first cushioning flap F1 is hinged to the first end panel 12 by a hinged connection 35 in the form of a fold line. A second cushioning flap F2 is hinged to the second end panel 16 by a hinged connection 37 in the form of a fold line.

The blank 10 comprises at least one cushioning structure for constraining articles within an interior volume of the carton. The cushioning structure serves as a brace or filler for reducing or inhibiting movement of the articles B within the carton 90. The cushioning structure is automatically erected when the top panel with which it is associated is folded into a closed condition.

The embodiment of FIG. 1 comprises four cushioning structures S1, S2, S3, S4. A first cushioning structure S1 is coupled to the first top panel 22*a* by a hinged connection 23*a*. A second structure S2 is coupled to the second top panel 22*b* by a hinged connection 23*b*. A third structure S3 is coupled to the third top panel 22*c* by a hinged connection 23*c*. A fourth structure S4 is coupled to the fourth top panel 22*d* by a hinged connection 23*d*.

The first cushioning structure S1 comprises a first, inner, top panel 24*a* hinged to the first top panel 22*a* by the hinged connection 23*a* which hinged connection takes the form of a fold line. The first cushioning structure S1 comprises a first securing flap 30*a*; the first securing flap 30*a* is hingedly connected to the first, inner, top panel 24*a* by a pair of intermediate panels 26*a*, 28*a*. A first intermediate panel 26*a* is hingedly connected to the first, inner, top panel 24*a* by a fold line 25*a*. A second intermediate panel 28*a* is hingedly connected to the first intermediate panel 26*a* by a fold line 27*a*. The second intermediate panel 28*a* is hingedly connected to the first securing flap 30*a* by a fold line 29*a*. The first intermediate panel 26*a* forms a first riser panel in a set up condition. The second intermediate panel 28*a* forms a first spacer panel in a set up condition for spacing the first intermediate panel 26*a* from the first end panel 12.

Optionally, the first securing flap 30*a* comprises a first cutaway C1. The first cutaway C1 is configured to be complementary to the handle opening in the first end panel 12. The first securing flap 30*a* may comprise one or more cushioning flaps F3 defining at least in part the first cutaway C1. In the embodiment of FIG. 1 three cushioning flaps F3 are provided about an upper periphery (when the handle structure is in use) of the first cutaway C1.

The first inner top panel 24*a* is arranged to have a smaller width dimension than the first end panel 12. The first top panel 22*a* is arranged such that at least a portion of the first top panel 22*a* has a smaller width dimension than the first end panel 12. In the illustrated embodiment this is achieved by providing a respective recess or cutaway C3, C4 along opposing side edges of the first top panel 22*a* and the first inner top panel 24*a*.

The second cushioning structure S2 comprises a second, inner, top panel 24*b* hinged to the second top panel 22*b* by the hinged connection 23*b* which hinged connection takes the form of a fold line. The second cushioning structure S2 comprises a second securing flap 30*b*. The second securing flap 30*b* is hingedly connected to the second, inner, top panel 24*b* by a pair of intermediate panels 26*b*, 28*b*. A first intermediate panel 26*b* is hingedly connected to the second, inner, top panel 24*b* by a fold line 25*b*. A second intermediate panel 28*b* is hingedly connected to the first intermediate panel 26*b* by a fold line 27*b*. The second intermediate panel 28*b* is hingedly connected to the second securing flap 30*b* by a fold line 29*b*. The first intermediate panel 26*b* forms a second riser panel in a set up condition. The second intermediate panel 28*b* forms a second spacer panel in a set up condition for spacing the first intermediate panel 26*b* from the first side panel 14.

The third cushioning structure S3 comprises a third, inner, top panel 24*c* hinged to the third top panel 22*c* by the hinged connection 23*c* which hinged connection takes the form of a fold line. The third cushioning structure S3 comprises a third securing flap 30*c*. The third securing flap 30*c* is hingedly connected to the third, inner, top panel 24*c* by a pair of intermediate panels 26*c*, 28*c*. A first intermediate panel 26*c* is hingedly connected to the third, inner, top panel 24*c* by a fold line 25*c*. A second intermediate panel 28*c* is hingedly connected to the first intermediate panel 26*c* by a fold line 27*c*. The second intermediate panel 28*c* is hingedly connected to the third securing flap 30*c* by a fold line 29*c*. The first intermediate panel 26*c* forms a third riser panel in a set up condition. The second intermediate panel 28*c* forms a third spacer panel in a set up condition for spacing the first intermediate panel 26*c* from the second end panel 16.

Optionally, the third securing flap 30*c* comprises a second cutaway C2. The second cutaway C2 is configured to be complementary to the handle opening in the second end panel 16. The third securing flap 30*c* may comprise one or more cushioning flaps F4 defining at least in part the second cutaway C2. In the embodiment of FIG. 1 three cushioning flaps F4 are provided about an upper periphery (when the handle structure is in use) of the second cutaway C2.

The third inner top panel 24*c* is arranged to have a smaller width dimension than the second end panel 16. The third top panel 22*c* is arranged such that at least a portion of the third top panel 22*c* has a smaller width dimension than the second end panel 16. In the illustrated embodiment this is achieved by providing a respective recess or cutaway C5, C6 along opposing side edges of the third top panel 22*c* and the third inner top panel 24*c*.

The fourth cushioning structure S4 comprises a fourth, inner, top panel 24*d* hinged to the fourth top panel 22*d* by the hinged connection 23*d* which hinged connection takes the form of a fold line. The fourth cushioning structure S4 comprises a fourth securing flap 30*d*. The fourth securing flap 30*d* is hingedly connected to the fourth, inner, top panel 24*d* by a pair of intermediate panels 26*d*, 28*d*. A first intermediate panel 26*d* is hingedly connected to the fourth, inner, top panel 24*d* by a fold line 25*d*. A second intermediate panel 28*d* is hingedly connected to the first intermediate panel 26*d* by a fold line 27*d*. The second intermediate panel 28*d* is hingedly connected to the fourth securing flap 30*d* by a fold line 29*d*. The first intermediate panel 26*d* forms a fourth riser panel in a set up condition. The second intermediate panel 28*d* forms a fourth spacer panel in a set up condition for spacing the first intermediate panel 26*d* from the second side panel 18.

The fourth securing flap 30*d* is arranged to have a smaller width dimension than the fourth top panel 22*d* or the second side panel 18 or both. In the illustrated embodiment this is achieved by providing a recess or cutaway C7 along one side edge of the fourth securing flap 30*d*. In this way the fourth securing flap 30*d* and the securing panel 20 can be adhered or otherwise secured to the second side panel 18 without being disposed in overlying relationship with each other.

Turning to the construction of the carrier 90 from the blank 10, the carrier 90 may be formed by a series of sequential folding operations in a straight line machine so that the carrier 90 may not be required to be inverted to complete its construction.

Glue or other adhesive treatment is applied to an inner surface of each of the first and second end panels 12, 16 and to each of the first and second side panels 14, 18. In other embodiments glue or other adhesive treatment is applied to an inner surface of the first, second, third and fourth securing flaps 30*a*, 30*b*, 30*c*, 30*d*.

The blank 10 is then folded about the fold lines 23*a*, 23*b*, 23*c*, 23*d* so as to bring the first, second, third and fourth securing flaps 30*a*, 30*b*, 30*c*, 30*d* into face contacting relationship with the respective one of the plurality of main panels 12, 14, 16, 18 to which they are hingedly connected. The first, second, third and fourth securing flaps 30*a*, 30*b*, 30*c*, 30*d* are secured to the respective one of the plurality of main panels 12, 14, 16, 18 to which they are hingedly connected.

The blank 10 is folded about fold line 13 so as to bring the first end panel 12 and the securing panel 20 into face contacting relationship with the first side panel 14.

Glue or other adhesive treatment is applied to an outer surface of the securing panel 20. In other embodiments glue or other adhesive treatment is applied to an inner surface of the second side panel 18.

The blank 10 is folded about fold line 17 so as to bring the second side panel 18 into overlying relationship with the second end panel 16 and a portion of the second side panel 18 into face contacting relationship with the securing panel 20. The second side panel 18 is secured to the securing panel 20.

In alternative embodiments the second side panel 18 may be secured to the glue panel 20 by alternative securing means for example, but not limited to, staples or other mechanical fixing means.

The blank 10 can be shipped or distributed in this form to a conversion plant where the blank 10 is erected about a group of articles B.

The flat collapsed carton may be erected into a tubular structure by separating the first side panel 14 from the second side panel 18. This may be achieved, for example, by unfolding the second side panel 18 about the fold line 17 with respect to the second end panel 16.

The carton 90, in its open ended tubular form, may be loaded with articles B through one of the open ends. It will be appreciated that in other embodiments one of the open ends of the carton 90 may be closed before loading the carton 90 with articles B through the remaining open end.

Once the carton 90 is loaded with articles B the ends of the tubular structure are closed.

A first, lower, end of the tubular structure is closed by folding the first base panel 32*a* and the third base panel 32*c* about fold lines 33*a*, 33*c* respectively.

Glue or other adhesive treatment may be applied to an outer surface of the first and third base panels 32*a*, 32*c* or, in alternative embodiments, to corresponding portions of an inner surface of each of the second and fourth base panels 32*b*, 32*d*.

The second and fourth base panels 32*b*, 32*d* are folded about fold lines 33*b*, 33*d* respectively so as to be brought into face contacting relationship with each of the first and third base panels 32*a*, 32*c*. The second and fourth base panels 32*b*, 32*d* are secured to each of the first and third base panels 32*a*, 32*c* so as to form a composite base panel.

A second, upper, end of the tubular structure is closed by folding each of the first and third top panels 22*a*, 22*c* (see FIG. 3) about the fold lines 21*a*, 21*c* respectively.

Glue or other adhesive treatment may be applied to an outer surface of the first and third top panels 22*a*, 22*c*.

The second and fourth top panels 22*b*, 22*d* can then be folded about the fold lines 21*b*, 21*d* respectively to be brought into contact with the first and third top panels 22*a*, 22*c* and secured thereto.

The assembled carton 90 is shown in FIG. 4.

Each of the cushioning structures S1, S2, S3, S4 is automatically erected when the respective one of the top panels 22*a*, 22*b*, 22*c*, 22*d* is folded with respect to the one of the plurality of main panels 12, 14, 16, 18 to which it is hinged.

Figure 3:
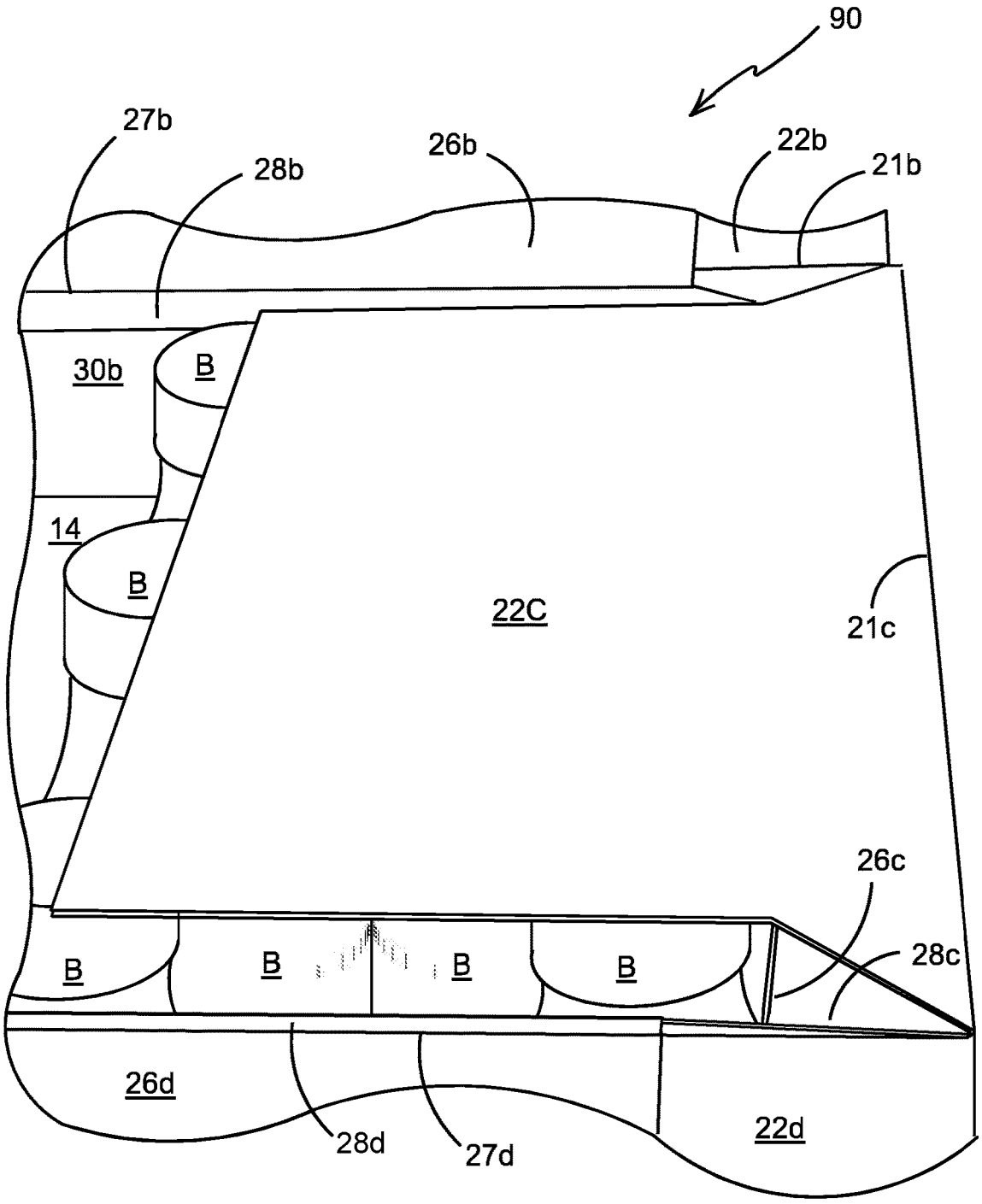
FIG. 3 is a perspective view of another stage of assembly of a carton from the blank of FIG. 1.

FIG. 3 shows the third cushioning structure S3 erected below the third top panel 22*c*. The first intermediate panel 26*c* is disposed proximate at least one article B. The second intermediate panel 28*c* spaces the first intermediate panel 26*c* from the second end panel 16 and serves as a bracing member therebetween. The opposed side edges of the third top panel 22*c* are spaced apart from the first and second side panels 14, 18 respectively. In this way a gap or void is provided to enable the second and fourth cushioning structures S2, S4 to be erected. The first intermediate panels 26*b*, 26*d* of each of the second and fourth cushioning structures S2, S4 extend through the gap or void. In this way a cushioning structure can be coupled to the outermost top panels 22*b*, 22*d* and can be automatically erected when the outermost top panels 22*b*, 22*d* are folded to close the second, upper, end of the carton 90.

Figure 5:
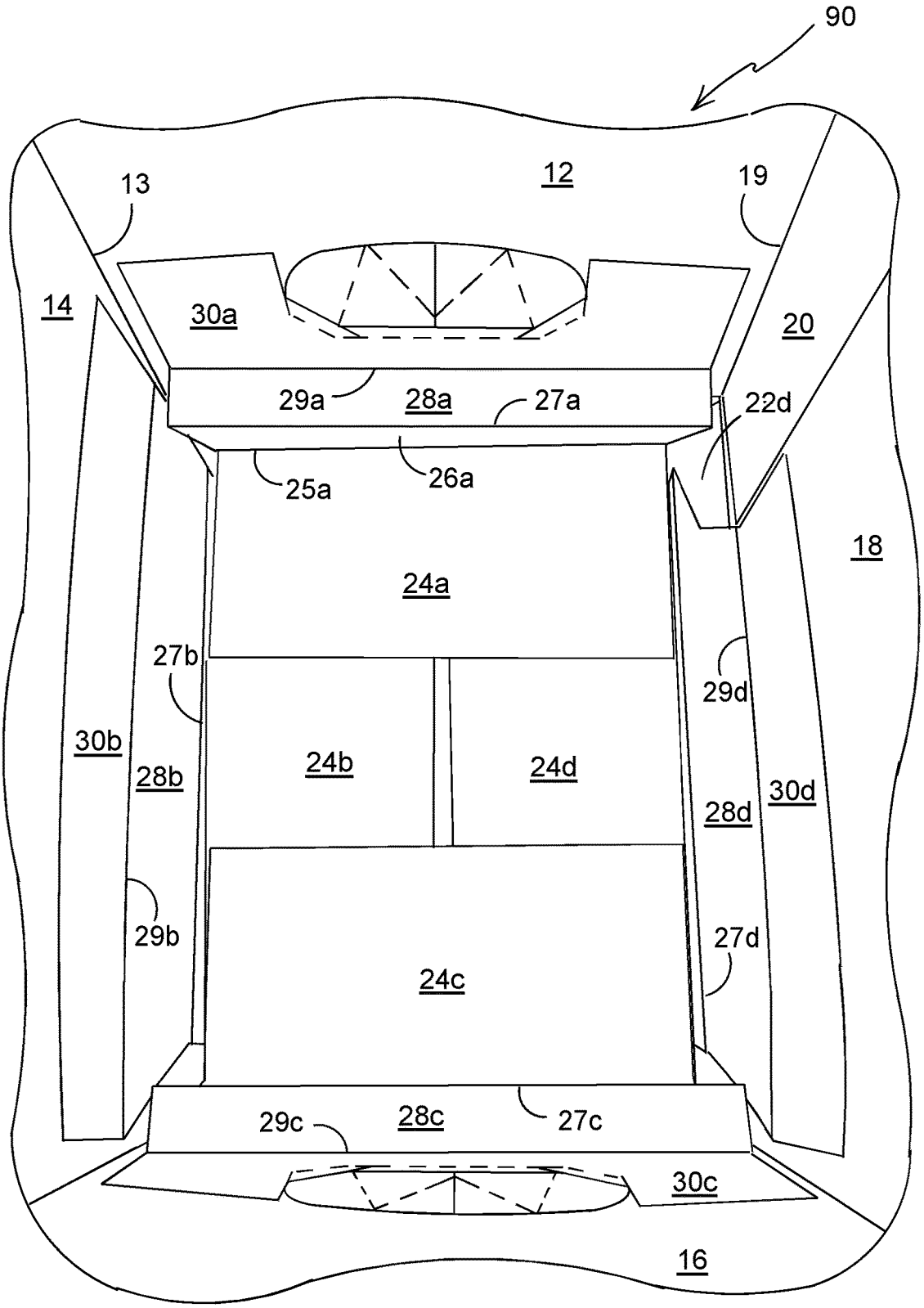
FIG. 5 is an internal view of an upper portion of the carton of FIG. 4 in which the articles have been removed for illustrative purposes.

FIG. 5 shows the first, second, third and fourth cushioning structures S1, S2, S3, S4 erected below a composite top panel formed from the first, second, third and fourth top panels 22*a*, 22*b*, 22*c*, 22*d*. The first, second, third and fourth cushioning structures S1, S2, S3, S4 together have the effect of reducing the internal width and length dimension of the carton 90 proximate the second, upper, end of the carton 90. The first, second, third and fourth cushioning structures S1, S2, S3, S4 are arranged about the perimeter of the upper end of the carton 90.

In an alternative embodiment, the first and third cushioning structures S1, S3 may comprise an alternative arrangement of panels. The first and second intermediate panels 26*a*, 26*c*; 28*a*, 28*c* of the first and third cushioning structures S1, S3 may be omitted. The first and third securing flaps 30*a*, 30*c* may be hinged directly to the first and third inner top panels 24*a*, 24*c* respectively by a hinged connection in the form of a fold line. Optionally, the fold line may be interrupted by one or more apertures; each of the one or more apertures may take the shape of an elongate oval. In such embodiments, the first and third inner top panels 24*a*, 24*c* may have a height dimension substantially equal to that of the first or third top panel 22*a*, 22*b* to which it is hinged. In this way the fold line between the first securing flap 30*a* and the first inner top panel 24*a* may be arranged to be substantially in registry with the fold line 21*a* between the first top panel 22*a* and the first end panel 12 when the first inner top panel 24*a* is folded into face contacting relationship with the first top panel 22*a*. Similarly, the fold line between the third securing flap 30*c* and the third inner top panel 24*c* may be arranged to be substantially in registry with the fold line 21*c* between the third top panel 22*c* and the second end panel 16 when the third inner top panel 24*c* is folded into face contacting relationship with the third top panel 22*c*.

Referring now to FIGS. 6 to 9, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 5 will be described in detail.

The blank 110 comprises a plurality of main panels 112, 114, 116, 118 for forming outer walls of a carton carrier 190 (see FIG. 9). The plurality of main panels 112, 114, 116, 118 includes a first end panel 112. The first end panel 112 is hinged to a first side panel 114 by a hinged connection such as a fold line 113. The first side panel 114 is hinged to a second end panel 116 by a hinged connection such as a fold line 115. The second end panel 116 is hinged to a second side panel 118 by a hinged connection such as a fold line 117. The first end panel 112 is hinged to a securing panel 120 by a hinged connection such as a fold line 119. The plurality of main panels 112, 114, 116, 118 define a tubular structure in a set up carton 190.

The blank 110 comprises at least one panel for forming a base wall of the carton 190. Optionally, the blank 110 comprises a first base panel 132*a* hinged to the first end panel 112 by a hinged connection such as a fold line 133*a*; a second base panel 132*b* hinged to the first side panel 114 by a hinged connection such as a fold line 133*b*; a third base panel 132*c* hinged to the second end panel 116 by a hinged connection such as a fold line 133*c*; and a fourth base panel 132*d* hinged to the second side panel 118 by a hinged connection such as a fold line 133*d*.

The blank 110 comprises a plurality of panels 122*a*, 122*b*, 122*c*, 122*d* for forming a composite top wall of the carton 190. The blank 110 comprises a first top panel 122*a* hinged to the first end panel 112 by a hinged connection such as a fold line 121*a*; a second top panel 122*b* hinged to the first side panel 114 by a hinged connection such as a fold line 121*b*; a third top panel 122*c* hinged to the second end panel 116 by a hinged connection such as a fold line 121*c*; and a fourth top panel 122*d* hinged to the second side panel 118 by a hinged connection such as a fold line 121*d*.

The blank 110 comprises at least one cushioning structure for constraining articles within an interior volume of the carton. The embodiment of FIG. 6 comprises four cushioning structures S1, S2, S3, S4. A first cushioning structure S1 is coupled to the first top panel 122*a* by a hinged connection 123*a*. A second structure S2 is coupled to the second top panel 122*b* by a hinged connection 123*b*. A third structure S3 is coupled to the third top panel 122*c* by a hinged connection 123*c*. A fourth structure S4 is coupled to the fourth top panel 122*d* by a hinged connection 123*d*.

The first and third cushioning structures S1, S3 are substantially the same in construction as those of the embodiment of FIG. 1.

The second cushioning structure S2 comprises a second, inner, top panel 124*b* hinged to the second top panel 122*b* by the hinged connection 123*b* which hinged connection takes the form of a fold line. The second cushioning structure S2 comprises a first brace panel 134*b*; the first brace panel 134*b* is hingedly connected to the second, inner, top panel 124*b* by a fold line 125*b*. The first brace panel 134*b* replaces the first and second intermediate panels 26*b*, 28*b* and second securing flap 30*b* of the first embodiment of FIG. 1.

The fourth cushioning structure S4 comprises a fourth, inner, top panel 124*d* hinged to the fourth top panel 122*d* by the hinged connection 123*d* which hinged connection takes the form of a fold line. The fourth cushioning structure S4 comprises a second brace panel 134*d*; the second brace panel 134*d* is hingedly connected to the fourth, inner, top panel 124*d* by a fold line 125*d*. The second brace panel 134*d* replaces the first and second intermediate panels 26*d*, 28*d* and fourth securing flap 30*d* of the first embodiment of FIG. 1.

The blank 110 of the embodiment shown in FIG. 6 is advantageous over the blank 10 of FIG. 1 in that the two or more blanks 110 may be arranged in a nested or tessellated arrangement. In this way the blank 110 reduces the required amount of substrate material thus providing economic and environmental benefits.

Figure 7:
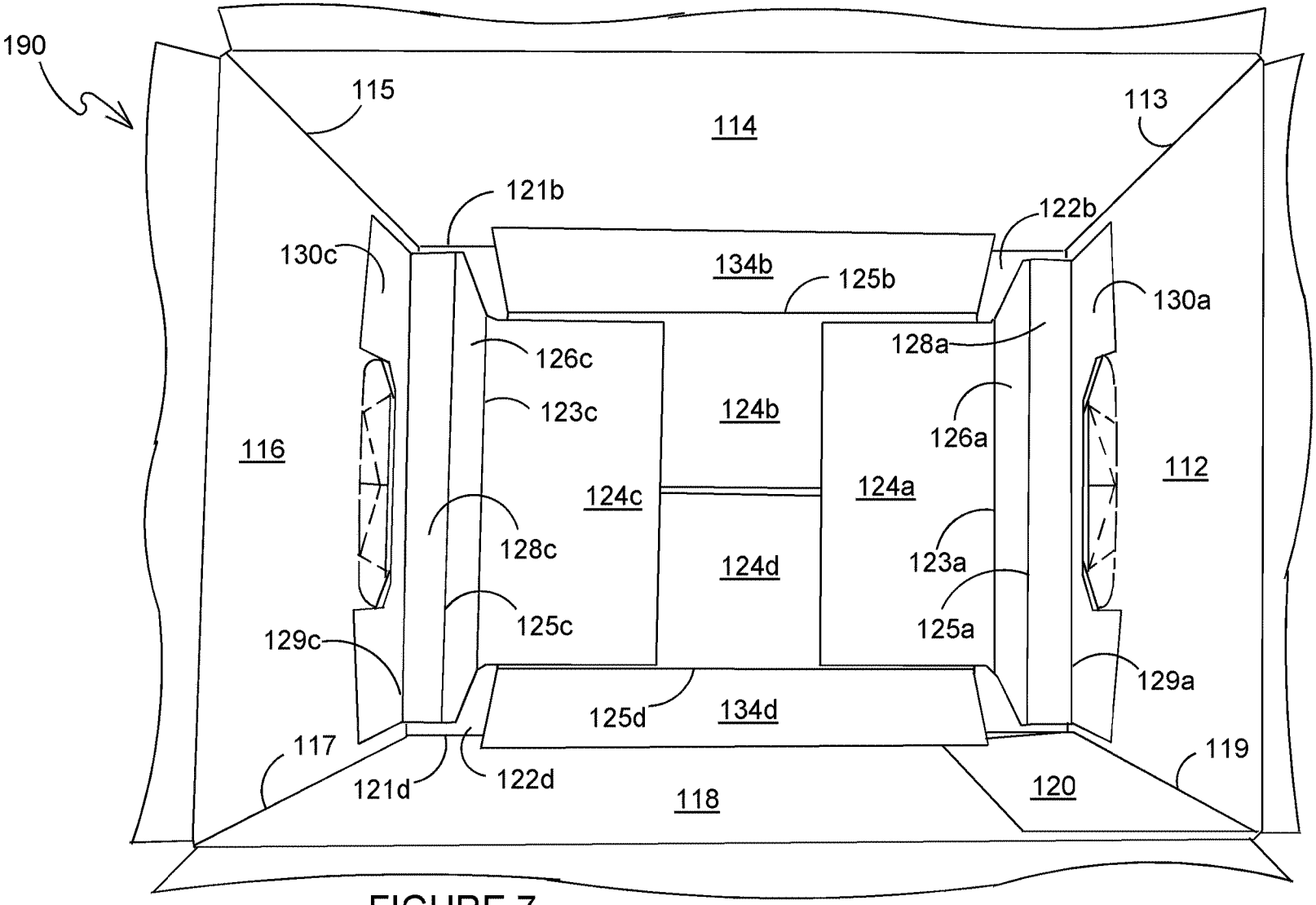
FIG. 7 is an internal view of an upper portion of a carton formed from the blank of FIG. 6 in which the articles have been removed for illustrative purposes.

Referring to FIG. 7, the first and second brace panels 134*b*, 134*d* are in contact with the inside surfaces of the outermost top panels 122*b*, 122*d* along the fold lines 125*b*, 125*d* respectively. The first and second brace panels 134*b*, 134*d*, however, extend from the fold lines 125*b*, 125*d* divergently away from the outermost top panels 122*b*, 122*d* through a respective gap or void between the first and third top panels 122*a*, 122*c* and the respective one of the first and second side panels 114, 118. The lower ends of the first and second brace panels 134*b*, 134*d* are in abutment on the inside surfaces of the first and second side panels 114, 118 respectively. Stated differently, the first and second brace panels 134*b*, 134*d* mostly are spaced apart from the outermost top panels 122*b*, 122*d* respectively while they are mostly spaced apart from the first and second side panels 114, 118 respectively. In this way, a three-dimensional cushioning structure which is coupled to each of the outermost top panels 122*b*, 122*d* can be automatically erected when the outermost top panels 122*b*, 122*d* are folded to close the second, upper, end of the carton 90.

The second and fourth inner top panels 124*b*, 124*d* are dimensioned such that the fold lines 125*b*, 125*d* are offset with respect to the fold lines 121*b*, 121*d* respectively when the second and fourth inner top panels 124*b*, 124*d* are folded into face contacting relationship with the respective one of the second or fourth top panel 122*b*, 122*d*; this facilitates automatic erection of the cushioning structures S2, S4 when the second or fourth top panels 122*b*, 122*d* are folded into a closed condition.

When the second or fourth top panels 122*b*, 122*d* are folded into a closed condition, a free end edge thereof is brought into contact with the respective first or second side panels 114, 118. The free end edge is opposed to the hinged connection 125*b*, 125*d*. This has the effect of erecting the cushioning structures S2, S4. The first brace panel 134*b* together with portions of the second top panel 122*b* and first side panel 114 define a tubular structure having a triangular cross sectional shape. Similarly, the second brace panel 134*d* together with portions of the fourth top panel 122*d* and second side panel 118 define a tubular structure having a triangular cross sectional shape.

Figure 8:
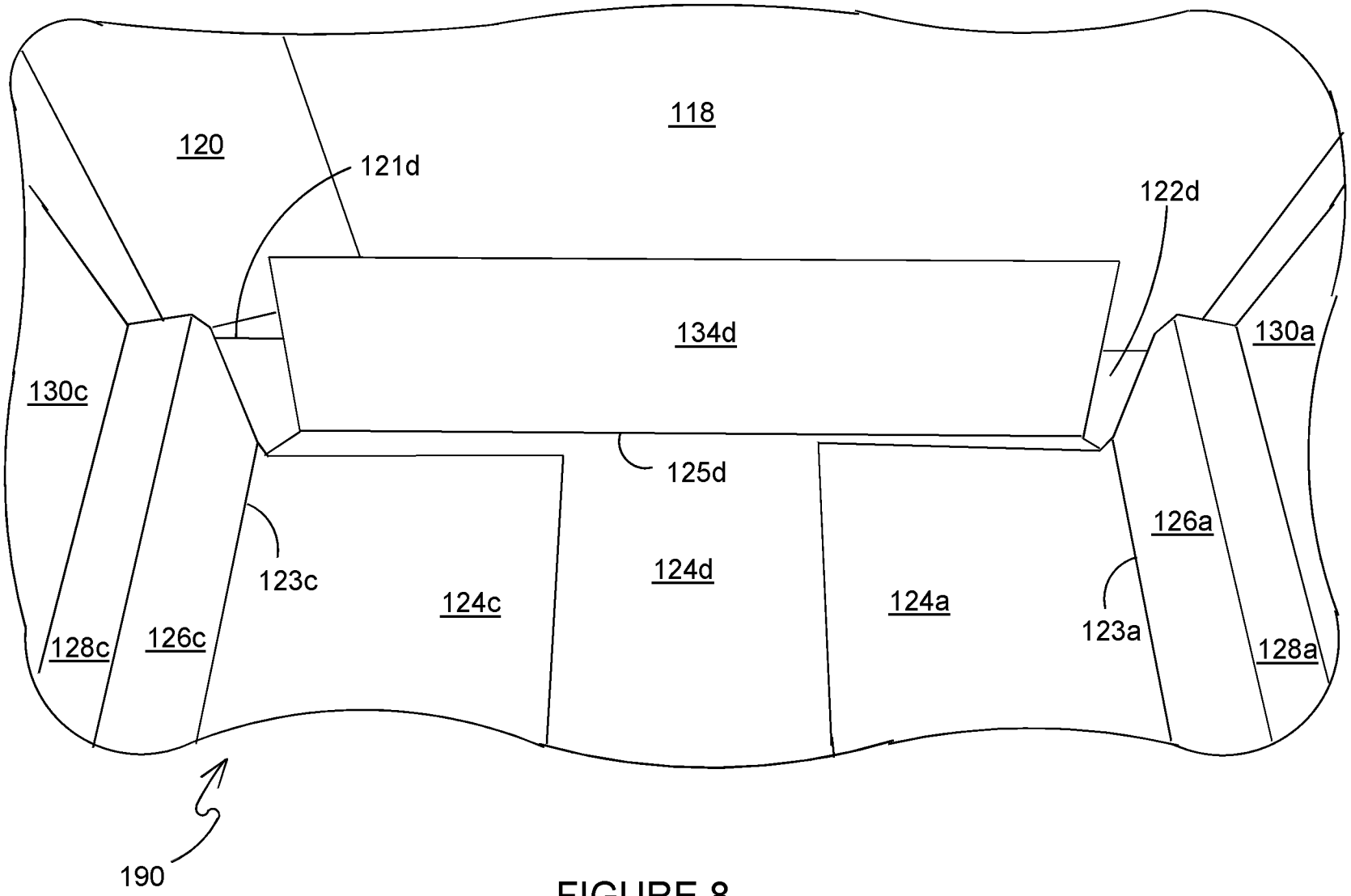
FIG. 8 is an enlarged view of a portion of FIG. 7.

The inherent resilience in the substrate material of the blank 110 has the effect of biasing the first brace panel 134*b* against the first side panel 114 when the second top panel 122*b* is in a closed condition. Similarly, the second brace panel 134*d* is biased against the second side panel 118 when the fourth top panel 122*d* is in a closed condition as shown in FIG. 8.

FIG. 7 shows the first, second, third and fourth cushioning structures S1, S2, S3, S4 erected below a composite top panel formed from the first, second, third and fourth top panels 122*a*, 122*b*, 122*c*, 122*d*. The first, second, third and fourth cushioning structures S1, S2, S3, S4 together have the effect of reducing the internal width and length dimension of the carton 90 proximate the second, upper, end of the carton 190. The first, second, third and fourth cushioning structures S1, S2, S3, S4 are arranged about the perimeter of the upper end of the carton 190.

The present disclosure teaches providing a tubular carton 90; 190 including an inner end closure flap provided by the first and third top panels 22*a*, 22*c*; 122*a*, 122*c* and an outermost end closure flap, provided by the second and fourth top panels 22*b*, 22*d*; 122*b*, 122*d*. The outermost end closure flap is arranged to at least partially overlie the inner end closure flap. The outermost end closure flap is associated with a self-erecting article-retaining sleeve structure, provided by the cushioning structures S2, S4. The self-erecting article-retaining sleeve structure also referred to herein as an automatically erecting article retaining structure is hinged to the outermost end closure flap. The automatically erecting article retaining structure can be erected from a first condition in which the structure is in flat collapsed form into second condition in which the automatically erecting article retaining structure adopts or defines in part a tubular structure with at least a portion of one of the walls 12, 14, 16, 18; 112, 114, 116, 118 of the carton 90. When the automatically erecting article retaining structure is hinged to an outer end closure flap hinged to one of the plurality of outer walls, a gap is provided between a side edge of an inner end closure flap and said one of the plurality of outer walls. The at least a portion of the automatically erecting article retaining structure is erected within the gap, when the outer end closure flap is brought into a closed position, in which it is folded about a hinged connection with said one of the plurality of outer walls.

In this way the automatically erecting article retaining structure is automatically transformed from a first, stowed, configuration which is substantially flat shape suitable for storage and shipping into second, deployed configuration when the end closure flap with which it is associated is folded to close at least partially the open end of the carton 90.

Additionally or alternatively, the present disclosure teaches providing a combination of at least one article B, in the form of a bottle, and a tubular carton 90; 190. The article B defines a tubular structure having a first tubular axis. Optionally the tubular structure of the article is substantially cylindrical in shape. The article ray comprise a main body and a neck portion; the neck portion may be provided at an upper portion of the article B. The neck portion comprises a reduced width or diameter than the main body of the article B. This reduction may be achieved by providing article walls with a tapered region so as to define a shoulder portion. The tubular carton 90; 190 comprises a second tubular axis. The article and carton may be arranged such that the first and second tubular axes are substantially parallel with respect to each other. The carton comprises at least one end closure flap provided by one of the plurality of top panels 22*a*, 22*b*, 22*c*, 22*d*; 122*a*, 122*b*, 122*c*, 122*d*. The at least one end closure flap includes a self-erecting, article neck-retaining sleeve structure, provided by one of the cushioning structures S1, S2, S3, S4. The self-erecting, article neck-retaining sleeve structure may define a third tubular axis. The third tubular axis may be arranged to be substantially perpendicular to one or both of the first and second tubular axes.

Another aspect of the present disclosure provides a carton blank 10; 110 for forming a tubular carton 90; 190, comprising: first and second tube waft-forming panels hinged next to each other. The first and second tube wall-forming panels are provided by the first end panel 12; 112 and the first side panel 14; 114 respectively. The carton blank 10; 110 comprises a first series of end closure panels 22*a*, 24*a*, 26*a*, 28*a*, 30*a* and a second series of end closure panels 22*b*, 24*b*, 26*b*, 28*b*, 30*b*. The first series of end closure panels 22*a*, 24*a*, 26*a*, 28*a*, 30*a* is hinged to the first tube wall-forming panel along a first side of the blank 10; 110. The second series of end closure panels 22*b*, 24*b*, 26*b*, 28*b*, 30*b* is hinged to the second tube wall-forming panel along the first side of the blank 10; 110. One of the first and second series of end closure panels may comprise three or more hinged panels. In some embodiments, at least one of the first and the second series of end closure panels may comprise five or more hinged panels. Optionally, both of the first and second series of end closure panels may comprise five or more hinged panels.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cut line, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles comprising:

a tubular structure having a plurality of outer walls defining an interior volume for receiving one or more articles;

an inner end closure flap hinged to a first one of the plurality of outer walls;

an outer end closure flap hinged to a second one of the plurality of outer walls, the outer end closure flap at least partially overlying the inner end closure flap;

an automatically erecting article retaining structure hingedly connected to the outer end closure flap;

wherein the inner end closure flap is dimensioned so as to provide a gap between a side edge thereof and the second one of the plurality of outer walls, the pap receiving at least a portion of the automatically erecting article retaining structure;

wherein the automatically erecting article retaining structure comprises a first panel hinged to the outer end closure flap and disposed in face to face relationship with the outer end closure flap;

wherein the automatically erecting article retaining structure comprises a second panel secured to an inner surface of the second one of the plurality of outer walls;

wherein the automatically erecting article retaining structure comprises a pair of intermediate panels hingedly connecting the second panel to the first panel.

2. A carton according to claim 1 wherein a first intermediate panel is hingedly connected to the first panel and forms a riser panel.

3. A carton according to claim 2 wherein a second intermediate panel is hingedly connected along a first edge to the first intermediate panel and is hingedly connected to the second panel along a second edge, the second edge opposing the first edge.

4. A carton according to claim 1 wherein a first intermediate panel extends through the gap between the side edge of the inner end closure flap and the second one of the plurality of outer walls.

5. A carton for packaging one or more articles comprising:

a tubular structure having a plurality of outer walls defining an interior volume for receiving one or more articles;

an inner end closure flap hinged to a first one of the plurality of outer walls;

an outer end closure flap hinged to a second one of the plurality of outer walls, the outer end closure flap at least partially overlying the inner end closure flap;

an automatically erecting article retaining structure hingedly connected to the outer end closure flap;

wherein the inner end closure flap is dimensioned so as to provide a gap between a side edge thereof and the second one of the plurality of outer walls, the pap receiving at least a portion of the automatically erecting article retaining structure;

wherein the automatically erecting article retaining structure comprises a first panel hinged to the outer end closure flap and disposed in face to face relationship with the outer end closure flap;

wherein the automatically erecting article retaining structure comprises a second panel hingedly connected to the first panel of the automatically erecting article retaining structure;

wherein the second panel is at least partially spaced apart from the second one of the plurality of outer walls.

6. A carton according to claim 5 wherein the second panel extends through the gap between the side edge of the inner end closure flap and the second one of the plurality of outer walls.

7. A carton according to claim 5 wherein the second panel is at least partially spaced apart from the first panel of the automatically erecting article retaining structure.

8. A carton according to claim 5 wherein the second panel is divergently arranged with respect to the first panel of the automatically erecting article retaining structure.

9. A carton according to claim 5 wherein the second panel is divergently arranged with respect to the second one of the plurality of outer walls.

10. A blank for forming a carton, the blank comprising:

a plurality of panels for forming outer walls of a tubular structure defining an interior volume for receiving one or more articles in a set up condition, an inner end closure flap hinged to a first one of the plurality of outer walls;

an outer end closure flap hinged to a second one of the plurality of outer walls, the outer end closure flap being arranged to at least partially overlie the inner end closure flap in a set up condition;

two or more panels hingedly connected in a linear series for forming an automatically erecting article retaining structure;

wherein the inner end closure flap is dimensioned so as to provide a gap between a side edge thereof and the second one of the plurality of outer walls, the pap receiving at least a portion of the automatically erecting article retaining structure;

wherein the two or more panels comprise a first panel hinged to the outer end closure flap and disposed in face to face relationship with the outer end closure flap;

wherein the two or more panels comprise a second panel secured to an inner surface of the second one of the plurality of outer walls;

wherein the two or more panels comprise a pair of intermediate panels hingedly connecting the second panel to the first panel.

11. A blank for forming a tubular carton comprising:

a first tube wall-forming panel;

a second tube wall-forming panel, the second tube wall-forming panel being hinged to the first tube wall-forming panel;

a first series of end closure panels, wherein the first series of end closure panels is hinged to the first tube wall-forming panel along a first side of the blank;

a second series of end closure panels, wherein the second series of end closure panels is hinged to the second tube wall-forming panel along the first side of the blank; and wherein each of the first and second series of end closure panels comprises three or more panels hingedly connected in series;

wherein each of the first and second series of end closure panels comprises five or more panels hingedly connected in series.

* * * * *